US005119639A

United States Patent [19]

Bein et al.

[11] Patent Number: 5,119,639

[45] Date of Patent: Jun. 9, 1992

[54] ICE LEVEL SENSOR

[75] Inventors: David L. Bein, Middleton; Chris R. Rieger, Madison, both of Wis.

[73] Assignee: Sub-Zero Freezer Company Inc., Madison, Wis.

[21] Appl. No.: 694,072

[22] Filed: May 1, 1991

[51] Int. Cl.[5] ..... F25C 5/18

[52] U.S. Cl. ..... 62/137; 62/344

[58] Field of Search ..... 62/137, 344, 353

[56] References Cited

U.S. PATENT DOCUMENTS

| | | | |
|---|---|---|---|
| 2,717,500 | 9/1955 | Ploeger | 62/344 X |
| 2,799,144 | 7/1957 | Barton | 62/137 |
| 2,976,697 | 3/1961 | Dahl | 62/137 |
| 3,290,892 | 12/1966 | Roedter | 62/137 |
| 3,581,516 | 6/1971 | Buchser et al. | 62/137 |
| 3,885,400 | 5/1975 | Webb | 62/137 |
| 4,947,652 | 8/1990 | Arcangeli | 62/137 X |

*Primary Examiner*—William E. Tapolcai
*Attorney, Agent, or Firm*—Foley & Lardner

[57] ABSTRACT

An ice sensing assembly for an ice making apparatus having a mold for making ice pieces and a bin for collecting ice pieces from the ice making apparatus, the ice sensing member including a bale and a triangularly shaped plastic member affixed to said bale to engage the ice pieces and having a minimal thickness and converging edges terminating at an apex for sensing the level of ice pieces in the bin.

5 Claims, 3 Drawing Sheets

ICE LEVEL SENSOR

FIELD OF THE INVENTION

This invention generally relates to automatic ice making devices of the type which are adapted to be installed within the freezer compartment of household refrigerators and more particularly relates to an ice level sensing member provided on the sensing assembly which prevents ice cubes or pieces from trapping or freezing on the sensing arm when in the sensing position in the ice bin.

BACKGROUND OF THE INVENTION

Many forms of ice sensing devices are provided with ice making equipment which generally rotate a metal or plastic arm toward an ice bin or bucket to sense the level of ice pieces. The sensing element is generally in the form of a sweep arm which moves into the ice bucket to sense the level of ice bodies therein. The sweep arm is generally made of a metallic material which often becomes covered or frozen with ice. If too much ice forms on the sensor, it becomes inoperative. In some systems ice is held back while the arm moves through the ice bucket to sense the level of ice bodies. A typical example of this type of system is shown in U.S. Pat. No. 3,581,516, entitled "Ice Body Maker Collecting Bin Control."

SUMMARY OF THE PRESENT INVENTION

The present invention provides a sensing assembly for sensing the level of ice pieces in a collecting bin which eliminates the possibility of the sensing member being trapped or frozen in the ice bodies or cubes when in the on or sensing position. This is accomplished by providing a triangularly shaped plastic member on the intermediate section of a sweep arm. The member having a minimal thickness with relatively smooth sides which prevent ice from mechanically fusing to the surface of the sensing member.

Thus, the present invention advantageously provides a sensing member having a surface which is resistant to ice formation and sufficiently flexible so that it can move into engagement with any obstructing ice cubes without becoming trapped or frozen thereon.

One of the features of the invention is the provision of converging edges on the sensing member which, on contact, cam the sensing assembly out of the path of the motion of the ice bin or bucket.

Other principal features and advantages of the invention will become apparent to those skilled in the art upon review of the following drawings, the detailed description and the appended claims.

DETAILED DESCRIPTION OF THE DRAWINGS

Figure 1:
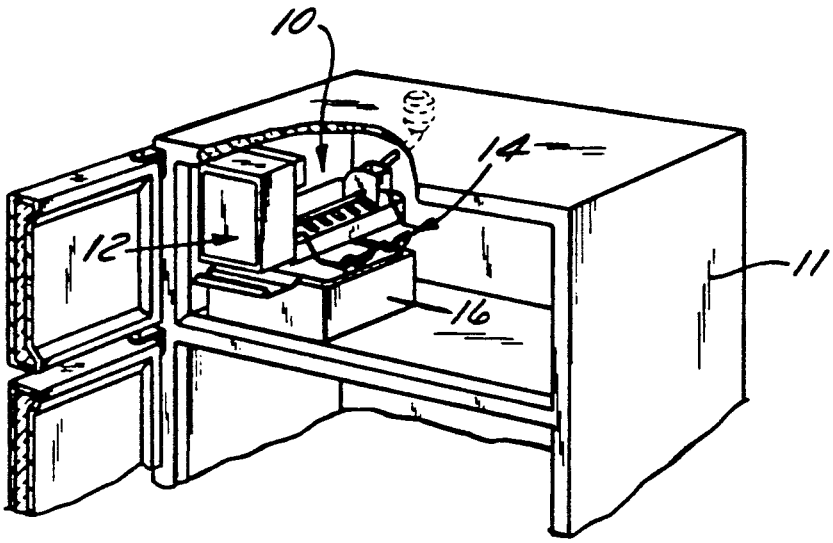
FIG. 1 is a perspective view of an ice maker assembly shown mounted in a freezer in a refrigerator.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DESCRIPTION OF THE PREFERRED EMBODIMENTS

In the exemplary embodiment of the invention shown in the drawings an apparatus generally designated 10 is illustrated for making ice cubes or pieces. The apparatus is mounted in the freezer compartment of a refrigerator 11. The apparatus 10 includes an ice maker 12 of a well known construction which is provided with an ice level sensing assembly 14 which is pivotally mounted for movement downwardly into a bin or receptacle 16. The bin 16 is arranged to collect ice pieces formed by the ice maker 12. Ice pieces are formed by the ice maker and delivered to the bin 16 in a conventional manner.

After the ice pieces are transferred into the receptacle the ice level sensing assembly 14 is activated to sense the level of the ice cubes in the bin 16. The sensing assembly 14 swings downward into the bin 16 until the assembly 14 engages the ice cubes or pieces therein. The sensing assembly 14 will engage the ice pieces precluding further movement of the assembly 14 into the bin 16. As the level of the ice pieces goes down, the sensing assembly 14 will follow the level of the ice pieces. When the level of ice drops far enough, the sensing element 14 will initiate an ice making cycle and automatically withdraw the sensing assembly 14 from the bin 16.

In accordance with the present invention the sensing assembly 14 generally includes a wire bale 18 having an elongate center section 20 and an end section 22 at each end. The bale 18 is mounted for pivotal movement about a horizontal axis located above the ice maker 12. The center section 20 moves toward the bin 16 to sense the level of the ice pieces. In accordance with the present invention, sensing member 24 is provided on center section 20 of the bale 18 to engage the ice pieces and thereby prevent the engagement of the center element 20 with the ice pieces.

In this regard the sensing member 24 is formed from a plastic material such as polypropylene of a maximum thickness of ⅛th inch. The member 24 is injection molded directly onto the center section 20 of the bale 18 so that it remains in a fixed position relative to the center section 20. As shown in the drawing, the sensing member 24 will be located in a generally vertical relation to the level of the ice pieces when the bin is full. As the ice pieces are removed, the member 24 will sense the drop in the level of the ice pieces and initiate an ice making operation to refill the bin 16.

The sensing member 24 is in the form of a triangle having a maximum thickness of approximately ⅛th inch. The base 26 of the member 24 is insert injection molded directly onto the center section 20 of the bale 18 so that it remains in a fixed position. The sides 30 of the member 24 are curved and converge toward a flat sensing tip 32 at the apex of the triangle. While the member 24 is flexible, it has sufficient rigidity to support the weight of the bale when it engages the ice pieces. The minimal thickness and flexible characteristics of the molded material allows the sensing member 24 to flex by any obstructing ice cubes that would normally trap a conventional sweep arm.

Figure 2:
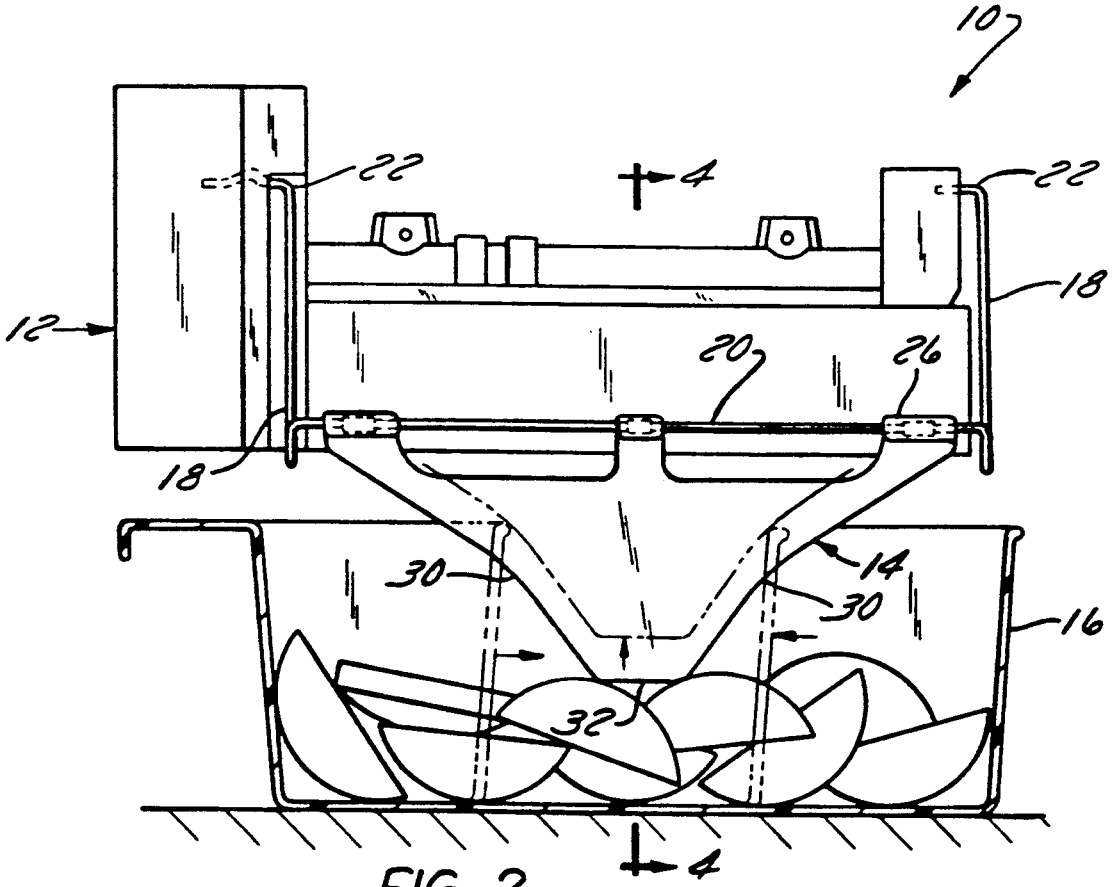
FIG. 2 is a view similar to FIG. 2 showing the sensor engaging the ice pieces in the bucket.
Figure 3:
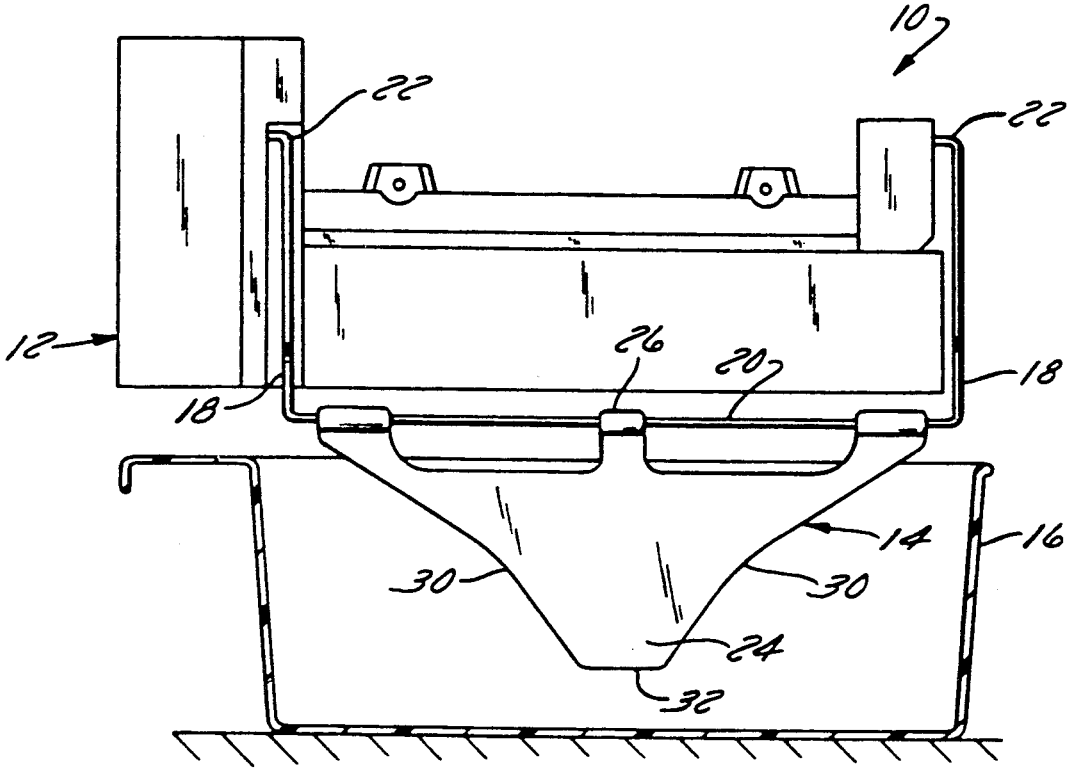
FIG. 3 is a side elevation view of the ice maker showing the sensor according to the invention in a sensing position in the bucket.
Figure 4:
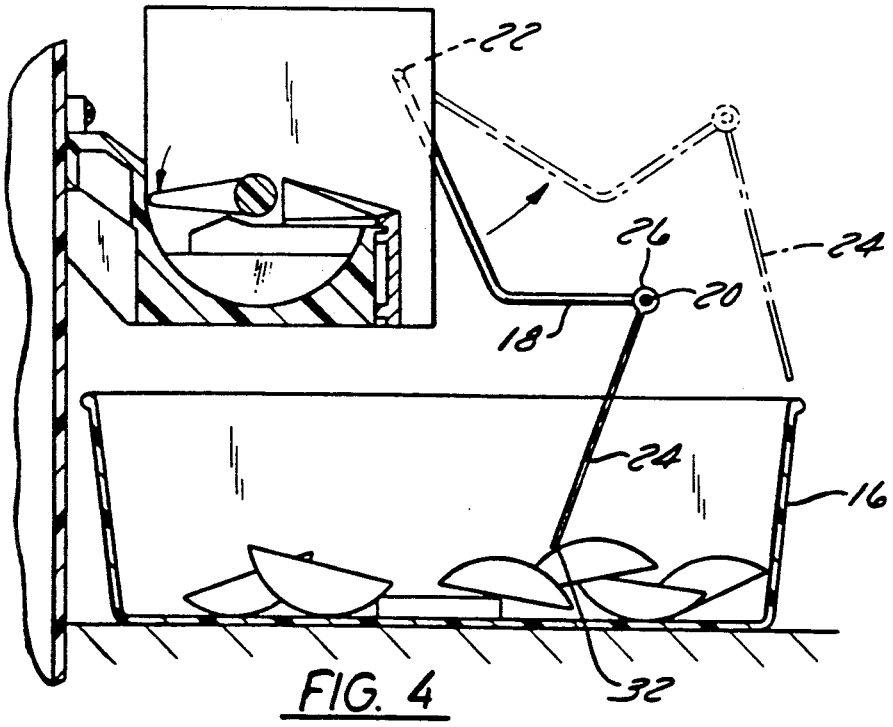
FIG. 4 is a cross sectional view taken along line 4—4 of FIG. 2.
Figure 5:
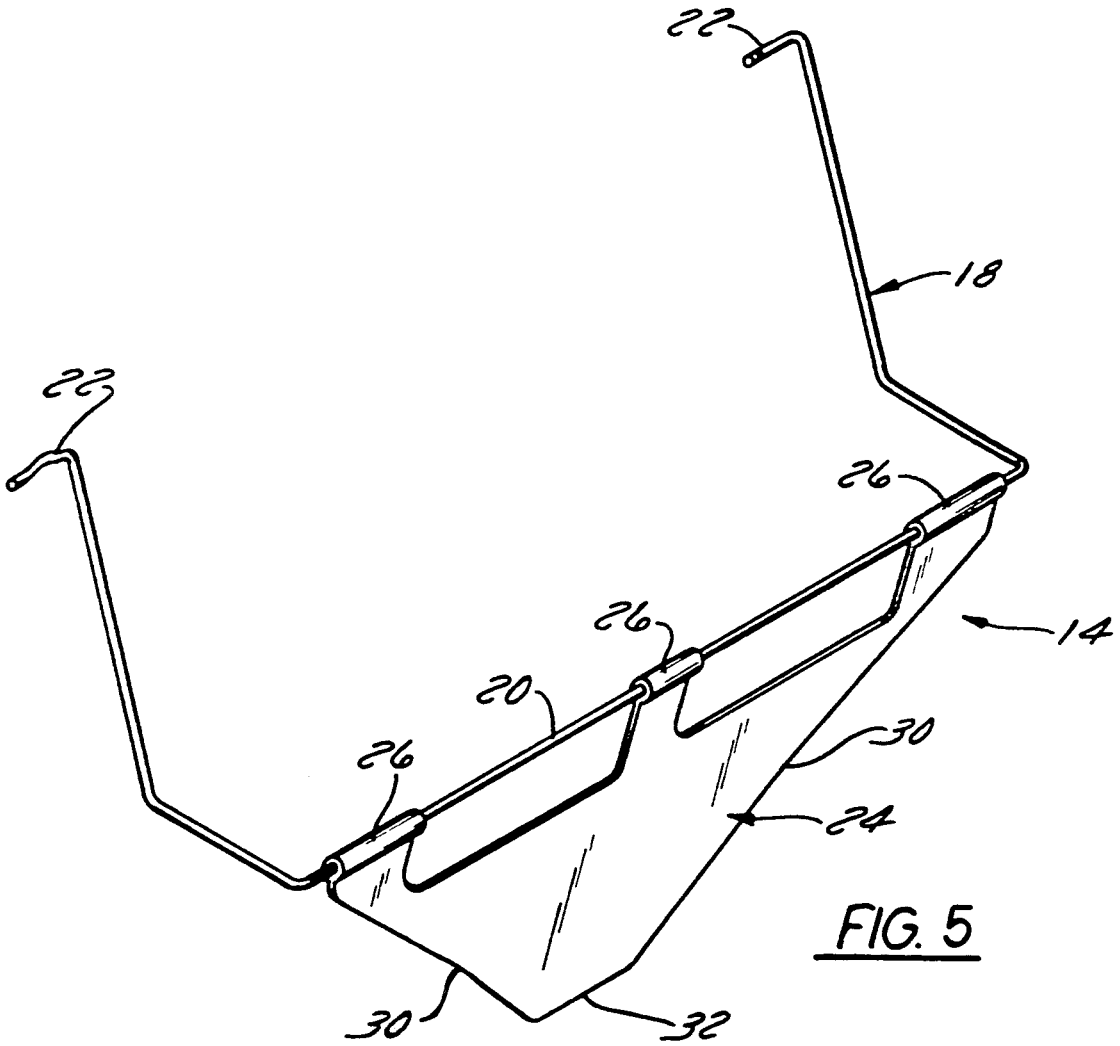
FIG. 5 is a perspective view of the sensor.

The curved converging sides 30 of the member 24 are aligned in a generally vertical relation to the longitudinal direction of movement of the bin 16 when removed or replaced in the freezer compartment. As shown in FIG. 2, when the bin 16 is removed from or replaced in the refrigerator, the end walls 16 of the bin will engage one or the other of the curved edges 30 on the member 24. The member 24 will be cammed upward over the top edge of the corresponding end wall of the bin 16 thereby allowing for easy removal or replacement of the ice bin in the refrigerator. The ice maker is disabled whenever the bin 16 is removed as is generally understood in the art.

Thus, it should be apparent that there has been provided in accordance with the present invention an ice level sensor that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. In an ice making apparatus having a mold for making ice pieces, a bin positioned adjacent the ice making apparatus for collecting ice pieces ejected from the ice making apparatus, and a sensing assembly for sensing the level of ice pieces in the bin, said assembly including a bale and a triangularly shaped plastic member affixed to said bale to engage the ice pieces wherein said triangularly shaped member has curved converging edges terminating at an apex, whereby the bin will cam said sensing assembly out of the path of the bin when the ice bin is moved longitudinally in and out of said ice making apparatus.

2. The sensing assembly according to claim 1 wherein said member is formed from a flexible, nonthermally conductive material.

3. The sensing assembly according to claim 1 wherein said triangularly shaped member has a thickness of ⅛th inch, maximum.

4. An ice sensing assembly for sensing the level of ice in an ice bucket, said assembly comprising a bale and a plastic member secured to said bale in a fixed position, said member having a triangular configuration and a maximum thickness of ⅛th inch wherein said triangularly shaped member has converging edges which are positioned to cam the bale out of the path of the bucket when the bucket engages said edges of the member.

5. The assembly according to claim 4 wherein said member is sufficiently flexible to allow the bale to flex by any obstructions.

* * * * *

UNITED STATES PATENT AND TRADEMARK OFFICE

CERTIFICATE OF CORRECTION

PATENT NO. : 5,119,639

DATED : June 9, 1992

INVENTOR(S) : David L. Bien and Chris R. Rieger

It is certified that error appears in the above-identified patent and that said Letters Patent is hereby corrected as shown below:

On the title page: Item

[75] Inventors: David L. Bien, Middleton; Chris R. Rieger, Madison, both of Wis.

Signed and Sealed this

Third Day of August, 1993

*Attest:*

Michael K. Kirk

MICHAEL K. KIRK

*Attesting Officer*

*Acting Commissioner of Patents and Trademarks*